US005470403A

United States Patent [19]

Yoshinaga et al.

[11] Patent Number: 5,470,403

[45] Date of Patent: Nov. 28, 1995

[54] COLD ROLLED STEEL SHEET AND HOT DIP ZINC-COATED COLD ROLLED STEEL SHEET HAVING EXCELLENT BAKE HARDENABILITY, NON-AGING PROPERTIES AND FORMABILITY, AND PROCESS FOR PRODUCING SAME

[75] Inventors: Naoki Yoshinaga; Kohsaku Ushioda; Osamu Akisue, all of Futtsu; Kunio Nishimura, Kitakyusyu, all of Japan

[73] Assignee: Nippon Steel Corporation, Tokyo, Japan

[21] Appl. No.: 196,098

[22] PCT Filed: Jun. 22, 1993

[86] PCT No.: PCT/JP93/00846

§ 371 Date: Feb. 18, 1994

§ 102(e) Date: Feb. 18, 1994

[87] PCT Pub. No.: WO94/00615

PCT Pub. Date: Jan. 6, 1994

[30] Foreign Application Priority Data

Jun. 22, 1992 [JP] Japan ..... 4-163083
Aug. 31, 1992 [JP] Japan ..... 4-232300

[51] Int. Cl.[6] ..... C21D 8/04; C22C 38/06; C22C 38/04; B32B 15/00

[52] U.S. Cl. ..... 148/330; 148/603; 148/533; 428/659

[58] Field of Search ..... 148/533, 603, 148/330, 320; 428/659

[56] References Cited

U.S. PATENT DOCUMENTS 4,368,084 1/1983 Irie et al. ..... 148/533

FOREIGN PATENT DOCUMENTS 53-22052 9/1973 Japan .
53-39368 5/1974 Japan .
50-75113 6/1975 Japan .
51-39524 4/1976 Japan .
58-57492 4/1980 Japan .
59-42742 11/1981 Japan .
57-57945 3/1982 Japan .
57-43932 3/1982 Japan .
57-203721 12/1982 Japan .
58-48636 3/1983 Japan .
58-141335 8/1983 Japan .
58-136721 8/1983 Japan .
3-277741 11/1983 Japan .
59-31827 2/1984 Japan .
59-38337 3/1984 Japan .
59-67320 4/1984 Japan .
59-143027 8/1984 Japan .
59-140333 8/1984 Japan .
60-197846 10/1985 Japan .

(List continued on next page.)

OTHER PUBLICATIONS

Abstract of JP 4–214820 published Aug. 5, 1992.
Abstract of JP 5–78783 published Mar. 30, 1993.
Abstract of JP 5–78784 published Mar. 30, 1993.
Supplementary European Search Report EP 93 91 3564 Nov. 18, 1994.

*Primary Examiner*—Deborah Yee
*Attorney, Agent, or Firm*—Kenyon & Kenyon

[57] ABSTRACT

The present invention provides a cold rolled steel sheet and a hot dip zinc-coated cold rolled steel sheet excellent in paint bake hardenability, non-aging properties and formability, and a process for producing the same. In the present invention, an extremely low carbon steel or extremely low carbon steel containing at least one element selected from the group consisting of Ti and Nb is used as a base steel, and Mn and Cr are positively added thereto, whereby the resultant steel has a mixed structure after annealing. Accordingly, there can be obtained a steel sheet having both a high paint bake hardenability and non-aging properties, and being excellent in formability such as an average r-value (deep drawability). With regard to the paint bake hardenability, the present invention may provide a cold rolled steel sheet and a hot dip zinc-coated cold rolled steel sheet to which paint bake hardening may be optionally imparted in an amount as large as about 10 kgf/mm$^2$ and which also have non-aging properties.

16 Claims, 1 Drawing Sheet

FOREIGN PATENT DOCUMENTS

| | | |
|---|---|---|
| 61-281852 | 12/1986 | Japan . |
| 62-40352 | 2/1987 | Japan . |
| 63-190141 | 8/1988 | Japan . |
| 1-62440 | 3/1989 | Japan . |
| 2-111841 | 4/1990 | Japan . |
| 2-232316 | 9/1990 | Japan . |
| 3-21611 | 2/1991 | Japan . |
| 3-226544 | 10/1991 | Japan . |
| 3-2224 | 12/1991 | Japan . |
| WO92/16668 | 10/1992 | WIPO . |

COLD ROLLED STEEL SHEET AND HOT DIP ZINC-COATED COLD ROLLED STEEL SHEET HAVING EXCELLENT BAKE HARDENABILITY, NON-AGING PROPERTIES AND FORMABILITY, AND PROCESS FOR PRODUCING SAME

FIELD OF THE INVENTION

The present invention relates to a cold rolled steel sheet and a hot dip zinc-coated cold rolled steel sheet having excellent paint bake hardenability, non-aging properties and formability, and a process for producing the same.

The cold rolled steel sheet according to the present invention is used for automobiles, electrical appliances and buildings after press forming. Moreover, the cold rolled steel sheet of the invention includes both a cold rolled steel sheet in a strict sense, namely, a cold rolled steel sheet without surface treatment, and a cold rolled steel sheet subjected to surface treatment such as Zn coating and alloyed Zn coating. Since the steel sheet of the invention has both strength and formability, the thickness of the sheet can be reduced, that is, the sheet can be lightened compared with conventional steel sheets, when used. Accordingly, the use of the sheet is considered to contribute to the maintenance of the global environment.

BACKGROUND OF THE INVENTION

Since the recent progress of vacuum degassing molten steel has made the ingot-making of extremely low carbon steel easy, demand for extremely low carbon steel sheets having good formability has further been increasing. Among the steel sheets, those extremely low carbon steel sheets in which Ti and Nb are compositely added and which are disclosed, for example, in Japanese Unexamined Patent Publication (Kokai) Nos. 59-31827 and 59-38337 have extremely good formability, bake hardening (BH) properties and excellent hot dip zinc coating characteristics. Accordingly, the extremely low carbon steel sheets occupy an important position. However, the amount of BH of the steel sheets does not exceed the level of conventional BH steel sheets, and has a drawback that they cannot secure their cold non-aging properties when a further amount of BH is tried to be imparted thereto.

Furthermore, there are many disclosures with regard to extremely low carbon steel sheets excellent in formability and containing neither Ti nor Nb, for example, in Japanese Examined Patent Publication (Kokoku) No. 53-22052, and Japanese Unexamined Patent Publication (Kokai) Nos. 58-136721 and 58 -141335.

On the other hand, many attempts have heretofore been made to increase the strength of steels while the formability thereof is being secured. Particularly, in the case of steels which have a tensile strength from 30 to 50 kgf/mm$^2$and to which the present invention relates, the strength thereof has been increased by adding P, Si, etc., to the steels and utilizing these solid solution strengthening mechanisms. For example, Japanese Unexamined Patent Publication (Kokai) Nos. 59-31827 and 59-33837 disclose processes for producing high strength cold rolled steel sheets having a tensile strength of up to a class of 45 kgf/mm$^2$ by adding mainly Si and P to extremely low carbon steel sheets to which Ti and Nb have been added. Japanese Examined Patent Publication (Kokai) No. 57-57945 disclose a typical prior technique relating to a process for producing a high strength cold rolled steel sheet by adding P to an extremely low carbon steel to which Ti has been added.

Moreover, in extremely low carbon steels containing neither Ti nor Nb, Japanese Examined Patent Publication (Kokoku) No. 58-57492 and Japanese Unexamined Patent Publication (Kokai) No. 58-48636 disclose techniques for highly strengthening steels by adding P, and Japanese Unexamined Patent Publication (Kokai) No. 57-43932 discloses a technique for utilizing Si.

As described above, heretofore P firstly and Si secondly have often been used as strengthening elements for reasons as described below. It has been considered that the addition of small amounts of P and Si increases the strength of a steel because of their very high solid solution strengthening capability, that the addition does not lower the ductility and deep drawability of the steel much, and that the addition cost does not increase much. However, in reality, when strengthening the steel with only these elements is tried, not only the strength but also the yield strength of the steel increases significantly. As a result, defects of surface shapes are sometimes formed, and the use of the steel for automobile panels may sometimes be restricted. Moreover, when the steel is hot dip coated with zinc, Si in the steel may induce the formation of poor coating, and P and Si may markedly lower the alloying rate. Accordingly, the addition of P and Si has a problem that they may lower the productivity of the steel products.

On the other hand, the use of Mn and Cr as solid-solution strengthening elements is also known. Japanese Unexamined Patent Publication (Kokai) Nos. 63-190141 and 64-62240 disclose techniques for adding Fin to Ti-containing extremely low carbon steel sheets, and Japanese Examined Patent Publication (Kokoku) No. 59-42742 and Japanese Examined Patent Publication (Kokoku) No. 57-57945 which is mentioned above disclose techniques for adding Mn and Cr to extremely low carbon steels to which Ti has been added.

Moreover, Japanese Unexamined Patent Publication (Kokai) No. 2-111841 discloses a cold rolled steel sheet and a hot dip zinc-coated steel sheet which have bake hardenability and good formability and which are prepared by adding Mn in an amount from at least 1.5% to less than 3.5% to an extremely low carbon steel prepared by adding Ti. Mn is added in a large amount for the purpose of lowering the Ar3 transformation point leading to the stabilization of the operation of hot rolling and forming a uniform metal structure. Moreover, the patent publication discloses the addition of Cr and V in an amount from 0.2 to up to 1.0% for the purpose of further improving the ductility. However, the invention is not based on the idea that the addition of large amounts of Mn and Cr improves mechanical properties, particularly a balance between the strength and the ductility. Furthermore, the amount of BH does not deviate from the conventional level in the invention, and the invention does not make the bake hardenability which is higher than conventional values compatible with the non-aging properties.

Furthermore, Japanese Unexamined Patent Publication (Kokai) No. 62-40352 discloses a technique for adding Mn to an extremely low carbon steel containing neither Ti nor Nb. However, the invention of the patent publication can be concluded as follows: (i) the addition of Mn and Cr plays only an auxiliary role of P and Si which are principal addition elements, and therefore the cold rolled steel sheet thus obtained has a high yield strength compared with its strength; and (ii) Mn and Cr are not added for purposes other than (i), for example, they are added for the purpose of neither (a) making the structure subsequent to annealing a mixed structure, nor (b) improving the work hardenability, nor (c) imparting BH to the steel, nor (d) improving the secondary formability, nor (e) improving the coating properties of the hot dip zinc coating.

Still furthermore, Japanese Unexamined Patent Publication (Kokai) Nos. 58-48636 and 57-203721 disclose processes for producing cold rolled steel sheets having excellent bake hardenability and deep drawability by adding a large amount of B to extremely low carbon steels to which Ti and Nb have not been added, and annealing at a temperature from 730° C. to the A3 point. However, these cold rolled steel sheets are composed of a ferrite single phase structure as a prerequisite of the invention quite different from the present invention.

In contrast to the steel sheets having a ferrite single phase structure as described above, steel sheets having composite structures are also known. These steel sheets are exemplified by the so-called Dual Phase steel (DP steel) in which a ferrite phase and a martensite phase are present in a mixture and which is prepared by adding alloying elements such as Si, Mn and Cr to a low carbon aluminum-killed steel, and optimizing a continuous annealing temperature and a subsequent cooling rate. Such a DP steel is known to have an extremely low yield ratio (YR) though it has a high strength, and is also known to have non-aging properties and a high BH. However, the DP steel has a drawback that it has a r-value as low as about 1.0 and a poor deep drawability. In addition, processes for producing such cold rolled steel sheets are disclosed in Japanese Examined Patent Publication (Kokoku) No. 53-39368 and Japanese Unexamined Patent Publication (Kokai) Nos. 50-75113 and 51-39524.

In contrast to these composite structure steel sheets prepared from low carbon aluminum-killed steels, Japanese Examined Patent Publication (Kokoku) Nos. 3-2224 and 3-21611 and Japanese Unexamined Patent Publication (Kokai) No. 3-277741 disclose composite structure steel sheets prepared from extremely low carbon steels. In the preparation of these steel sheets, Ti is further compositely added to extremely low carbon steels in addition to large amounts of Nb and B, and a composite structure of a ferrite phase and phases transformed at a low temperature are formed after annealing, whereby cold rolled steel sheets having a high r-value, a high BH, a high ductility and cold non-aging properties are obtained.

Particularly with regard to Japanese Unexamined Patent Publication (Kokai) No. 3-277741, the patent publication discloses a technique for providing a steel sheet having a bake hardenability, non-aging properties and in addition formability wherein a steel prepared by adding Nb, B and Ti, and in addition Mn and Cr to an extremely low carbon steel is annealed at a temperature from at least AC1-50° C. to less than the Ac1 transformation point to form a structure consisting of a composite structure composed of acicular ferrite having a volume ratio of up to 5% and ferrite. However, as a result of detailed investigation by the present inventors, it has become evident that the technique has the following problems. That is, in a composite structure steel sheet having a second phase in an amount of up to 5% by volume, imparting BH to the steel at least at a conventional level, namely, in an amount exceeding 5 kgf/mm$^2$ is difficult, and when the amount of BH exceeds 5 kgf/mm$^2$, the YP-El sometimes exceeds 0.2%, securing the non-aging properties of the steel thus being found to be extremely difficult. For example, a Nb-containing steel containing 0.004% of C, 0.01% of Si, 1.5% of Mn, 1.0% of Cr, 0.05% of P, 0.025% of Nb, 0.04% of Al, 0.0025% of N and 0.01% of S has been annealed while the holding temperature has been changed in the range from 840° to 865° C. whereby the volume ratio of the second phase has been changed from 0 to 20%, and the relationship between the amount of BH and the YP-El after artificially aging the steel has been examined. The results thus obtained are shown in FIG. 1. It is clear from FIG. 1 that securing the non-aging properties of the steel becomes difficult when the steel contains the second phase in an amount of up to 5% by volume. This is probably caused by an insufficient density of migrational dislocations introduced into the ferrite because of a small volume ratio of the second phase.

Furthermore, Japanese Unexamined Patent Publication (Kokai) No. 60-197846 discloses a technique for obtaining a steel having such properties as described above by adding a large amount of B to an extremely low carbon steel containing neither Ti nor Nb. However, as a result of intensively examining the technique, the present inventors have found that forming a composite structure by adding such a large amount of B involves problems as described below:

1) A steel containing such a large amount of B does not lower its Ac1 transformation point. As a result, to obtain a composite structure, annealing the steel at an extremely high temperature becomes essential, resulting in troubles such as rupture of the steel sheets during continuous annealing.
2) Since the temperature range of $\alpha+\gamma$ of the steel is extremely narrow, the structure may change in the width direction, or the material of the steel may greatly vary, or a composite structure may be formed or may not be formed when the annealing temperature changes in a magnitude of several degrees centigrade. The production of the steel therefore becomes extremely unstable.
3) The addition of B in a large amount brings about the deterioration of the steel ductility.
4) The addition of B in a large amount causes the formation of a defective metallic coating. The steel is therefore inappropriate for a hot dip zinc-coated steel sheet.
5) Moreover, imparting BH in an amount of at least 5 kgf/mm$^2$ becomes not only difficult, the steel to which BH is imparted in an amount exceeding 5 kgf/mm$^2$ exhibits a YP-El exceeding 0.2% after artificial aging. As a result, the non-aging properties of the steel are not secured.

As described above, there have been several proposals on composite structure steel sheets in extremely low carbon steels. However, the amount of BH does not deviate from the conventional level at all, and the non-aging properties remain at a level only slightly exceeding the conventional one.

DISCLOSURE OF THE INVENTION

Steel sheets used for panels of automobiles are strictly required to have good surface shaping properties, for example, not forming a springback and a surface strain after pressing. The surface shaping properties of steel sheets are known to become preferable as the yield strength becomes low. However, highly strengthening steel sheets generally involves a considerable increase of the yield strength as described in the prior art. Accordingly, in the case of increasing the strength of steel sheets, it is required to inhibit the increase of the yield strength as much as possible.

Moreover, steel sheets are required to have resistance to dent formation after press forming. The resistance to dent formation herein signifies that the steel sheets have resistance to a permanent recessed deformation of the steel sheets when an assembled automobile is hit with a stone, etc. The resistance to dent formation of a steel sheet becomes high as the deformation stress subsequent to press forming and paint baking becomes high if the sheet thickness is constant. Accordingly, among steel sheets having the same yield strength, those steel sheets which have a higher paint bake hardenability and a higher working hardenability exhibit a more improved resistance to dent formation.

It can be concluded from the above illustration that a steel sheet desirable for panels, etc., of automobiles is one that has not so high a yield strength, that work hardens significantly, and that has a high paint bake hardenability at the same time. The steel sheet is naturally required to be excellent in formability such as an average r-value (deep drawability) and elongation (bulging characteristics) and substantially non-aging at room temperature.

The present invention satisfies the desire as described above, and an object of the invention is to provide a cold rolled steel sheet and a hot dip zinc-coated cold rolled steel sheet to which, particularly with regard to the paint bake hardenability, BH can be imparted in an amount as high as about 10 kgf/mm$^2$ in accordance with its application, which has both non-aging properties (YP-El: less than 0.2 after artificial aging) and formability, and which has not been obtained in the known literature as described above.

The present inventors have carried out intensive research to achieve the object as described above, and obtained novel knowledge as described below.

That is, an extremely low carbon steel containing neither Nb nor Ti and an extremely low carbon steel containing Nb and/or Ti have been used as base steels, and the effects of the addition of B, Mn and Cr to the base steels on relationships between structures and tensile strength after cold rolling, annealing and temper rolling have been investigated in detail while much attention has been paid to Ac1 and $\alpha \rightarrow \gamma$ transformation behaviors of the steels during annealing. Although a composite structure comprising ferrite and phases transformed at low temperature have been obtained by adding B in an amount of at least 0.0040% as a result of the investigation, the following results have been confirmed: 1) annealing the steel at a temperature fairly high compared to conventional ones is essential to obtain the composite structure; 2) since the temperature range for making the steel have the desired composite structure is extremely narrow, variation in the steel materials during production is extremely great; 3) it is difficult to impart BH in an amount of at least 5 kgf/mm$^2$to such a steel, and in addition the yield point elongation (YP-El) of the steel after artificial aging exceeds 0.2% when the steel has BH in an amount of at least 5 kgf/mm$^2$, securing the cold non-aging properties becoming impossible; and 4) the steels are extremely sensitive to cooling conditions after annealing, and the sensitivity also makes the material characteristics of the steels such as the amount of BH and the average r-value markedly unstable. Moreover, when Ti and/or Nb is added, similar tendencies have been observed in either of the following cases: composite addition of Nb and B, composite addition of Ti and B, and composite addition of Nb, Ti and B.

In contrast to the above-mentioned steels, the results as described below have been obtained from steels which have been prepared by adding Mn and/or Cr to the above-mentioned extremely low carbon steel and which have been made to contain greater than 5% of the phases transformed at low temperature based on the entire volume.

1) Since these elements are $\gamma$-phase-forming ones, the steels have the low $\alpha \rightarrow \gamma$ transformation point, and do not require so high an annealing temperature though they are extremely low carbon steels.

2) In addition, since the steels have an extremely wide $\alpha \rightarrow \gamma$ dual phase region, variation in the materials during production is extremely small.

3) Furthermore, BH in an amount of at least 5 kgf/mm$^2$can be easily imparted to the steels. Even when BH in an amount of about 10 kgf/mm$^2$ is imparted to the steels, the YP-El after artificial aging does not exceed 0.2%. Accordingly, the very excellent non-aging properties and bake hardenability are found to be compatible with each other in the steels. According to the present inventors' inference, the compatibility is probably brought about by the higher migrational dislocation density in the low temperature transformation product and ferrite introduced therearound in the steels in which a mixed structure is formed by adding Mn and Cr than in steels having a composite structure formed by composite addition of B.

4) Furthermore, it is one of the important characteristics of the steels that mixed structure steel sheets in which Mn and Cr have been added exhibit good mechanical properties such as the r-value and BH regardless of cooling conditions after annealing, and that the steel sheets can therefore be easily produced. The improvement of the r-value becomes significant when Ti and Nb are not added. Moreover, even those steels to which Mn and Cr have been added cannot exhibit these properties when an excessively large amount of B (at least 0.0030% by weight) is added.

The influence of Mn, Cr, P and Si which are intended to be used as strengthening elements for highly strengthening steels on mechanical properties of the steels has been investigated with regard to each of the elements, and as a result novel knowledge as described below has been obtained.

That is, it has been found that Si and P which have heretofore been often used as solid solution strengthening elements a) significantly increase firstly the yield strength of steels when added thereto in trace amounts, and b) as a result markedly reduce the working hardenability of the steels in a low strain region.

On the other hand, there has been obtained the following extremely important novel knowledge that the addition of Mn and Cr which have heretofore been seldom used a) barely not increases the yield strength of steels and increases the tensile strength, and b) as a result rather increases the working hardenability thereof in a low strain range.

This is probably the reason why the steel of the present invention exhibits a low yield ratio, in addition to the formation of a mixed structure caused by the addition of Mn and Cr. Moreover, such a reduction of P and Si in the steel is also significant in that the reduction lowers the $\alpha \rightarrow \gamma$ transformation point.

Furthermore, the present inventors have found that the steel of the present invention has advantages as a hot dip zinc-coated cold rolled steel sheet. That is, a steel to which Si and P have been added in large amounts is known to exhibit deteriorated coating properties at the time of hot dip coating with zinc and in addition a delayed alloying reaction after coating. However, even when a steel to which Mn and Cr have been added contains at the same time large amounts of Si and P, its hot dip zinc coating properties are found not to be impaired. The present inventors have further investigated the influence of B, and found that a large amount of B in the steel exerts adverse effects on the coating properties in hot dip coating with zinc, and alloying reaction characteristics of the steel.

The present invention has been achieved based on such an idea and such novel knowledge, and the subject matter of the invention is as described below.

That is, the present invention relates to a cold rolled steel sheet and a hot dip zinc-coated cold rolled steel sheet having a mixed structure comprising a low temperature transformation product and ferrite, which is composed of, in terms of percentage by weight, from 0.0005 to 0.0070% of C, from 0.001 to 0.8% of Si, from 0.3 to 4.0% of Mn, from 0.003 to 0.15% of P, from 0.0005 to 0.015% of S, from 0.005 to 0.20% of Al, from 0.0003 to 0.0060% of N, optionally less than 0.0030% of B, said B satisfying the condition $B/N \leqq 1.5$, and from 0.01 to 3.0% of Cr, and the balance Fe and unavoidable impurities.

Furthermore, the present invention relates to a process for producing a cold rolled steel sheet or hot dip zinc-coated cold rolled steel sheet, which comprises finish hot rolling a slab having the components as described above at a temperature of at least (Ar3-100)°C., coiling the rolled product at a temperature from 800° C. to room temperature, cold rolling the product at a draft of at least 60%, continuously annealing the resultant sheet at a temperature from at least the $\alpha \rightarrow \gamma$ transformation point to up to the Ac3 transformation point, or hot dip coating the resultant sheet with zinc, for example, by in-line annealing type procedure wherein the annealing temperature is set at a temperature from at least the $\alpha \rightarrow \gamma$ transformation point to up to the Ac3 transformation point.

Furthermore, the present invention relates to a cold rolled steel sheet or hot dip zinc-coated cold rolled steel sheet having a mixed structure comprising a low temperature transformation product in an amount exceeding 5% by volume based on the total volume and ferrite, which is composed of, in terms of percentage by weight, from 0.0005 to 0.0070% of C, from 0.001 to 0.8% of Si, from 0.8 to 4.0% of Mn, from 0.005 to 0.15% of P, from 0.0010 to 0.015% of S, from 0.005 to 0.1% of Al, from 0.0003 to 0.0060% of N, less than 0.0005% of B, one or two elements selected from the group consisting of Ti in an amount from 0.003 to 0.1% and Nb in an amount from 0.003 to 0.1%, optionally from 0.01 to 3.0% of Cr, and the balance Fe and unavoidable impurities.

Still furthermore, the present invention relates to a process for producing a cold rolled steel sheet or hot dip zinc-coated cold rolled steel sheet, which comprises finish hot rolling a slab having the components as described above at a temperature of at least (Ar3-100)°C. at the time of hot rolling, coiling the rolled product at a temperature from 800° C. to room temperature, cold rolling the product at a draft of at least 60%, continuously annealing the resultant sheet at a temperature from at least the $\alpha \rightarrow \gamma$ transformation point to up to the Ac3 transformation point, or hot dip coating the resultant sheet with zinc, for example, by an in-line annealing type procedure wherein the annealing temperature is set at from at least the $\alpha \rightarrow \gamma$ transformation point to up to the Ac3 transformation point.

DETAILED DESCRIPTION OF THE DRAWING

Figure 1A:
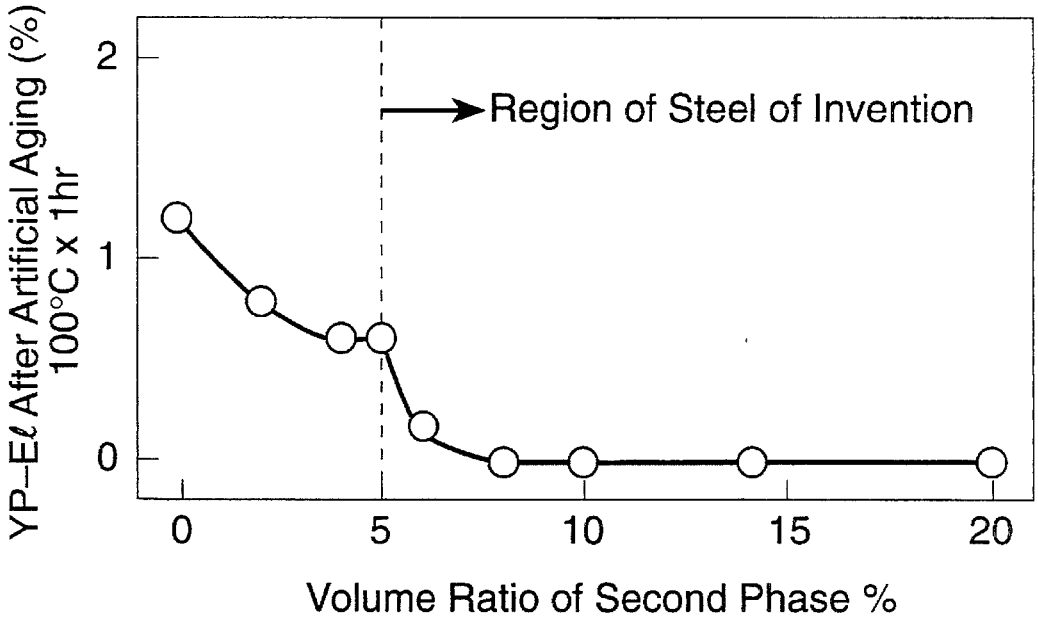
Figure 1B:
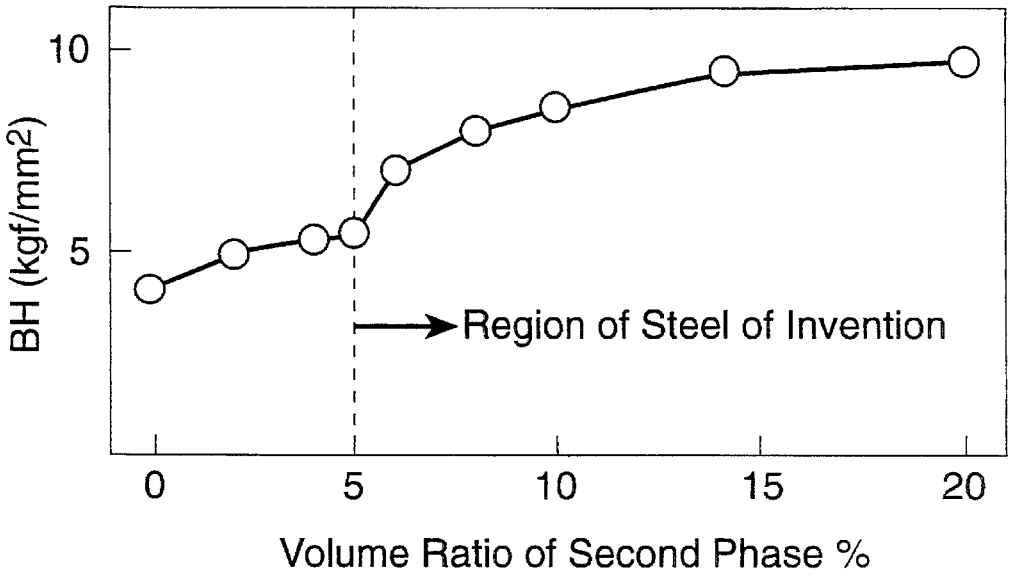

FIG. 1(*a*) and FIG. 1(*b*) are graphs showing a relationship between the volume ratio of the second phase and the BH, and one between the volume ratio and the YP-El after artificial aging.

BEST MODE FOR PRACTICING THE PRESENT INVENTION

The reasons for restricting the steel compositions and the production conditions as described above are further illustrated below.

C: C is an extremely important element that determines the material properties of products. An extremely low carbon steel having been vacuum degassed is a prerequisite of the present invention. Since the steel containing less than 0.0005% of C lowers its grain boundary strength and exhibits deteriorated secondary formability, the lower limit of C is defined to be 0.0005%. On the other hand, since the steel containing greater than 0.0070% of C exhibits deteriorated formability and cannot secure its cold non-aging properties, the upper limit of C is defined to be 0.0070%.

Si: Si is known to be as an element which increases the strength of the steel at low cost, and the addition amount of Si varies depending on the desired strength level of the steel. However, the steel containing greater than 0.8% of Si exhibits an excessively high yield strength, and produces a surface strain at the time of press forming. Moreover, the $\alpha \rightarrow \gamma$ transformation point rises, and the annealing temperature of the steel for obtaining the mixed structure becomes considerably high. Furthermore, the steel comes to have problems such as lowering of the sensitivity to chemical conversion, lowering of the adhesion of hot dip zinc coating, lowering of the productivity caused by the retardation of alloying reaction, and the like. The lower limit of Si is defined to be 0.001% in view of the steel production techniques and the cost.

Mn, Cr: Mn and Cr are the most important elements in the present invention. That is, since Mn and Cr lower the $\alpha \rightarrow \gamma$ transformation point of the steel, the steel does not require a very high temperature for forming the mixed structure. In addition, since Mn and Cr widen the $\alpha+\gamma$ dual phase region, the volume ratio of the mixed structure can be easily controlled. As a result, there is less variation of the steel material during the production, and the addition improves the productivity. Furthermore, BH in an amount of at least 5 $kgf/mm^2$ which cannot usually be obtained can be easily imparted to the mixed structure steel sheet obtained by utilizing Mn and Cr. The steel sheet thus having BH even in an amount of at least 5 $kgf/mm^2$ exhibits very excellent non-aging properties. The properties are peculiar to the mixed structure steel sheet obtained by utilizing Mn and Cr, and cannot be obtained from a ferrite single phase structure steel sheet and a composite structure steel sheet obtained by adding a large amount of B. Furthermore, it is an important point that the steel to which Mn and Cr have been positively added exhibits an almost non-deteriorated r-value even when annealed in the $\alpha+\gamma$ dual phase region, though an ordinary steel is known to exhibit a markedly lowered r-value when annealed in the $\alpha+\gamma$ region.

Still furthermore, Mn and Cr are effective solid solution strengthening elements which increase the strength of the steel without greatly increasing the yield strength of the steel, improve the chemical conversion properties, and have the effect of improving hot dip zinc coating properties. In the present invention, Mn is an essential element, and Cr is optionally added. That is, Mn is more effective than Cr in lowering the $\alpha \rightarrow \gamma$ transformation point and widening the $\alpha+\gamma$ dual phase region, and therefore Mn is utilized. Since Cr has excellent effects on improving the BH, enhancing the work hardenability, and the like, it is added to the steel when these properties of the steel are desired to be further improved.

The steel to which Mn has been added in an amount of less than 0.3% does not significantly exhibit the effects as described above when Ti and Nb are not added. Accordingly, the lower limit of Fin is defined to be 0.3%. On the other hand, since the steel to which Mn has been added in an amount greater than 4.0% does not form a good mixed structure, the upper limit is defined to be 4%. Moreover, when Ti and Nb are added to the steel, the resultant steel does not exhibit the effects as described above significantly if the addition amount of Mn is less than 0.8%. The steel does not form a good mixed structure when the addition amount of Mn exceeds 4%. Accordingly, the addition amount of Mn is defined to be in the range from 0.8 to 4.0%.

Furthermore, since the steel to which Cr has been added in an amount of less than 0.01% does not exhibit the addition effects, the lower limit is defined to be 0.01%. Since the steel to which Cr has been added in an amount greater than 3.0% does not form a good mixed structure, the upper limit is defined to be 3.0%.

P: P is known, similarly to Si, to increase the strength of the steel at low cost. The addition amount of P varies in accordance with the desired strength. The steel to which P has been added in an amount greater than 0.15% requires a markedly high temperature of annealing to form a mixed structure and exhibits an excessively increased yield strength which causes a defective surface shape during pressing. Moreover, the steel exhibits an extremely retarded alloying reaction during continuous hot dip zinc coating, and lowers the productivity. The steel also exhibits deteriorated secondary formability. Accordingly, the upper limit is defined to be 0.15%. Furthermore, the lower limit is defined to be 0.003% in view of the steel production techniques and the cost. In addition, the lower limit of P is preferably defined to be 0.005% in view of such points as described above when Ti and Nb are added.

S: Though a smaller amount of S in the steel is preferable, the production cost of the steel becomes high when the amount of S is made less than 0.0005%. Accordingly, the lower limit of the amount of P is defined to be 0.0005%. On the other hand, when the amount of Mn in the steel exceeds 0.015%, MnS is precipitated in a large amount, whereby the formability of the steel is deteriorated. Accordingly, the upper limit of the amount of S is defined to be 0.015%. In addition, in the case of adding Ti and Nb, the lower limit of the amount of S in the steel is preferably defined to be 0.001% for the same reason as described above.

Al: Though Al is used for deoxidation of the steel and fixing N, Al in an amount less than 0.005% in the steel is not sufficient to achieve the effects. On the other hand, the use of Al in an amount greater than 0.20% makes the steel costly. Accordingly, the upper limit of the amount of Al is defined to be 0.20%. In addition, in the case of adding Ti and Nb, the upper limit of the amount of Al is preferably defined to be 0.1% for the same reason as described above.

N: A smaller amount of N in the steel is preferable. However, when the amount of N is made less than 0.0003%, the steel becomes very costly. On the other hand, when the amount of N therein is excessively large, the use of Al in a large amount becomes necessary, and the form ability of the steel is deteriorated. Accordingly, the upper limit of the amount of N is defined to be 0.0060%.

Ti, Nb: Ti and Nb play the role of securing the formability and non-aging properties of an extremely low carbon steel by fixing all or part of N, C and S. Moreover, Ti and Nb refine crystal grains of a hot rolled steel sheet, and make the formability of the product sheet good. Accordingly, Ti and Nb are added to the steel when such properties are further required. When the amount of Ti and Nb is less than 0.003%, the addition effects cannot be achieved. Accordingly, the lower limit of the amount of Ti and Nb is defined to be 0.003%. On the other hand, since the use of Ti and Nb in an amount greater than 0.1% brings about a marked increase in the alloy cost, the upper limit of the amount of Ti and Nb is defined to be 0.1%.

B: Since B is effective in preventing secondary work embrittlement, it may be added. However, to secure cold non-aging properties of the steel in the case where the amount of BH exceeds 5 kgf/mm$^2$ while the formability thereof is being taken into consideration, the addition amount of B is defined to be less than 0.0030% when Ti and Nb are not added, or less than 0.0005% when Ti and/or Nb is added.

In addition, in the former case, it is preferable that B should be added in view of the formability of the steel so long as the condition $B/N \leqq 1.5$ is satisfied.

Subsequently, reasons for restricting the production conditions will be illustrated below.

A steel having a composition as described above is prepared at first, and cast to give a slab using a conventional continuous casting equipment. In the continuous casting, a slab having a thickness comparable to that of a hot rolled sheet may be cast by the so-called synchronous continuous casting process in which there is no relative speed difference between the slab and the inner wall of the mold, for example, by a process of a single roll type, twin roll type, or belt type.

The slab is then heated at a temperature from 1000 to 1300° C., and hot rolled. From the standpoint of securing the formability of the product sheet, the slab is finish hot rolled at a temperature of at least (Ar3-100)°C., and coiled. Coiling is carried out at a temperature from 800° C., preferably 750° C., to room temperature. That is, the present invention is characterized by its product material which is insensitive to the coiling temperature after hot rolling. Since Mn, Cr, etc., are added in fairly large amounts, the hot rolled sheet has a significantly fine and uniform structure. The insensitivity of the product is considered to be partly due to the structure. For the purpose of preventing the yield lowering caused by the material deterioration at both edges of the coil, the upper limit of the coiling temperature is defined to be 800° C.

The hot rolled steel strip thus obtained is used in cold rolling. Conventional conditions are satisfactory for the cold rolling. To secure deep drawability of the steel strip after annealing, the draft is defined to be at least 60%.

The cold rolled strip thus obtained is annealed. That is, the cold rolled steel strip is transferred to a continuous annealing furnace, optionally overaged, and annealed under predetermined conditions. When the steel strip is to be coated with zinc, it is annealed using the continuous annealing furnace, transferred to an off-line coating bath, and subjected to coating treatment. In this case, the cold rolled steel strip may also be subjected to coating treatment after transferring the strip to the continuous hot dip zinc coating equipment of an in-line annealing type.

In the present invention, such conditions for annealing are important to obtain a mixed structure of ferrite and phases transformed at low temperature (second phase) such as acicular ferrite, martensite, austenite or bainite. Particularly when Ti and/or Nb is added, the conditions are important because the phase transformed at low temperature is required to be formed in an amount of at least 5% based on the entire volume.

That is, when Ti and Nb are not added, C in the steel is in a state of being dissolved thereinto. As a result, the steel exhibits a good bake hardenability. However, to improve the non-aging properties of the steel, the steel should be heated to the austenite region to precipitate a second phase and form a mixed structure by heating the steel. In this case, even when the amount of the second phase precipitation is up to 5%, there can be obtained a steel having the YP-El mentioned above of less than 0.2%. However, to obtain a steel stably having non-aging properties, the precipitation amount should preferably be made greater than 5%.

On the other hand, in the case of adding Ti and Nb to the steel, Ti and Nb form carbides, and therefore C is in a precipitated state. Accordingly, for the purpose of improving the bake hardenability of the steel, the carbides should be dissolved in the steel to form dissolved C. It is therefore important to heat the steel to the austenite region and dissolve the carbides. Heating the steel in this temperature region significantly improves the non-aging properties FIG. 1 shows a relationship between the volume ratio % of the second phase and the amount of BH and a relationship between the volume ratio % of the second phase and the YP-El after artificial aging. The YP-El drastically decreases to become less than 0.2% when the volume ratio of the second phase exceeds 5%, and becomes approximately 0 when the volume ratio is near 8%. That is, the steel is capable of becoming substantially in a non-aging state at room temperature. The amount of BH drastically increases to become at least 5 kgf/mm$^2$ when the volume ratio of the second phase exceeds 5%, and becomes approximately 10 kgf/mm$^2$ when the volume ratio is 20%.

Accordingly, in the case of this steel, it becomes important that the volume ratio of the second phase should exceed 5%.

(Conditions for annealing cold rolled steel strip)

The cold rolled steel strip is soaked in an annealing furnace in a temperature range from at least the $\alpha \rightarrow \gamma$ transformation point to up to the Ac3 transformation point.

When the soaking temperature is less than the $\alpha \rightarrow \gamma$ transformation point, the second phase characteristic to the present invention, namely, the low temperature transformation product, cannot be obtained. Moreover, since the steel which has been annealed at a temperature exceeding the Ac3 transformation point exhibits markedly deteriorated formability, the upper limit of the annealing temperature is defined to be the Ac3 transformation point.

Although the rate of heating the steel to the soaking temperature is not specified, the rate is preferably in a range from 5° to 20° C./sec. In addition, the steel may also be heated rapidly at a rate of about 1000° C./sec.

The soaking time is in a range from 0 to several minutes.

Although the average cooling rate of the steel from the soaking temperature is not specified, the steel is cooled at a rate of preferably up to 30° C./sec in the temperature range from 650° to 750° C. when the product is particularly required to have a low yield strength and a high ductility, and preferably at least 30° C./sec when the product is particularly required to have an excellent bake hardenability and non-aging properties.

In addition, in the case of adding Ti and/or Nb, the volume ratio of the second phase can be made greater than 5% by controlling the soaking temperature in the range mentioned above in accordance with the chemical components of the steel.

(Conditions for annealing hot dip zinc-coated cold rolled steel strip)

Although the rate of heating the coated cold rolled steel strip to the soaking temperature is not specified, the strip is heated preferably at a rate in a range from 3 to 30° C./sec. In addition, the strip may also be heated at a high rate of approximately 1000° C./sec.

The soaking temperature and the holding time may be similar to those of the cold rolled strip.

The steel strip is cooled at a rate from 1° to 600° C./sec from the soaking temperature, and coated with zinc by immersing the strip in a coating bath (temperature: 420° to 520° C., Al concentration in the bath: 0.05 to 0.3%).

The cooling rate may be varied in accordance with desired conditions for the products as in the case of the cold rolled steel sheet.

After coating the steel strip with zinc, the strip is heated at a rate from 1° to 1000° C./sec, held at a temperature in a range from 480° to 600° C. for 1 to 60 sec, and cooled at a rate from 1° to 200° C./sec to room temperature, whereby alloying treatment of the zinc coating is achieved.

The cold rolled steel strip and the hot dip zinc-coated steel strip are produced as described above, and then they are optionally temper rolled at a draft from 0.1 to 2%.

According to the present invention, there can thus be obtained a steel sheet having a low yield strength, a significant work hardenability and a high paint bake hardenability, and excellent in an average r-value (deep drawability) and an elongation (bulging properties). Especially with regard to the paint bake hardenability, a large amount of BH of about 10 kgf/mm$^2$ can optionally be imparted to the steel sheet, and the present invention may provide a cold rolled steel sheet or hot dip zinc-coated cold rolled steel sheet which has in addition non-aging properties.

The present invention will be illustrated below by reference to examples.

EXAMPLE 1

Steel slabs having compositions as shown in Table 1 were prepared, and hot rolled under the following conditions to give steel strips each having a thickness of 4.0 mm: a slab heating temperature of 1200° C., a finish temperature of 902° C. and a coiling temperature of 700° C. The steel strips were pickled, and cold rolled at a draft of 80% to give cold rolled steel sheets each having a thickness of 0.8 mm. The steel sheets were continuously annealed under the following conditions: a heating rate of 10° C./sec, a soaking temperature from 810° to 950° C. and a soaking time of 50 sec, an average rate of cooling to 650° C. of 5° C./sec, and an average rate of cooling from 650° C. to room temperature of 80° C./sec. The resultant sheets were further temper rolled at a draft of 1.0%. Tensile test pieces of JIS No. 5 were taken from the sheets, and tensile tested. The tensile test results are summarized in Table 2.

The amount of WH herein designates an amount of work hardening when a tensile strain of 2% is imparted to the test pieces in the rolling direction, and is obtained by subtracting a yield stress (YP) from a 2% deformation stress. Moreover, the amount of BH is an amount of a stress increase when the 2% prestrained test pieces are heat treated at 170° C. for 20 minutes (heat treatment corresponding to baking finish) and tensile tested again (value obtained by subtracting 2% deformation stress from lower yield stress at the time of tensile testing again). Moreover, the secondary work brittle transition temperature is a ductility-brittle transition temperature obtained by punching the temper rolled steel sheets to give blanks having a diameter of 50 mm, forming cups with a punch having a diameter of 33 mm, and subjecting the cups to a drop weight tear test.

It is evident from Table 2 that the steels of the present invention have a high paint bake hardenability which has never been obtained in steel sheets of conventional steels having a tensile strength of the same level and in addition a very excellent non-aging properties. The principal reason for obtaining the preferable results from the steels of the present invention is considered to be as follows: those steel sheets which are made to have a mixed structure by adding Mn and Cr have a preferable dislocation density compared with steel sheets which are made to have a composite structure by adding B. Moreover, the steels of the present invention have a low yield strength, excellent surface shaping properties, a large amount of WH and a high r-value. Accordingly, the steels are appropriate materials, for example, for outside and inside panels of automobiles.

TABLE 1

| Steel No. | Chemical components of steels (wt. %) C | Si | Mn | P | S | Al | Cr | N | B | B/N | Soaking temp. °C. | Annealed structure | Note |
|---|---|---|---|---|---|---|---|---|---|---|---|---|---|
| 1-1 | 0.0025 | 0.012 | 0.34 | 0.008 | 0.007 | 0.05 | — | 0.0017 | 0.0005 | 0.29 | 890 | mixed structure | Steel of invention |
| 1-2 | 0.0033 | 0.009 | 0.70 | 0.007 | 0.005 | 0.05 | 0.5 | 0.0021 | — | — | 890 | mixed structure | Steel of invention |
| 1-3 | 0.0025 | 0.011 | 0.13 | 0.014 | 0.006 | 0.04 | — | 0.0016 | 0.0032 | 2.00 | 920 | mixed structure | Comparative steel |
| 2-1 | 0.0014 | 0.013 | 1.25 | 0.032 | 0.005 | 0.04 | — | 0.0022 | 0.0010 | 0.45 | 880 | mixed structure | Steel of invention |
| 2-2 | 0.0042 | 0.010 | 1.20 | 0.008 | 0.005 | 0.04 | 0.7 | 0.0016 | — | — | 880 | mixed structure | Steel of invention |
| 2-3 | 0.0039 | 0.021 | 0.55 | 0.015 | 0.008 | 0.05 | — | 0.0022 | 0.0040 | 1.82 | 910 | mixed structure | Comparative steel |
| 2-4 | 0.0027 | 0.011 | 0.20 | 0.011 | 0.007 | 0.04 | 0.5 | 0.0025 | 0.0059 | 2.36 | 920 | mixed structure | Comparative steel |
| 2-5 | 0.0020 | 0.550 | 0.10 | 0.016 | 0.005 | 0.04 | — | 0.0016 | 0.0002 | 0.13 | 880 | ferritic single phase | Comparative steel |
| 3-1 | 0.0019 | 0.008 | 1.54 | 0.065 | 0.006 | 0.04 | 1.0 | 0.0021 | 0.0008 | 0.38 | 860 | mixed structure | Steel of invention |
| 3-2 | 0.0038 | 0.009 | 1.65 | 0.070 | 0.005 | 0.04 | — | 0.0017 | 0.0004 | 0.24 | 870 | mixed structure | Steel of invention |
| 3-3 | 0.0039 | 0.009 | 0.15 | 0.090 | 0.006 | 0.04 | 0.8 | 0.0019 | 0.0035 | 1.84 | 920 | mixed structure | Comparative steel |
| 3-4 | 0.0041 | 0.022 | 1.20 | 0.025 | 0.006 | 0.04 | — | 0.0016 | 0.0045 | 2.81 | 900 | mixed structure | Comparative steel |
| 3-5 | 0.0030 | 0.150 | 0.55 | 0.090 | 0.005 | 0.04 | 0.3 | 0.0022 | — | — | 870 | ferritic single phase | Comparative steel |
| 4-1 | 0.0055 | 0.009 | 1.50 | 0.080 | 0.006 | 0.05 | — | 0.0020 | 0.0003 | 0.15 | 850 | mixed structure | Steel of invention |
| 4-2 | 0.0031 | 0.011 | 2.10 | 0.075 | 0.008 | 0.04 | 1.3 | 0.0018 | — | — | 830 | Mixed structure | Steel of invention |
| 4-3 | 0.0075 | 0.850 | 0.35 | 0.060 | 0.005 | 0.05 | 0.2 | 0.0022 | 0.0036 | 1.64 | 950 | mixed structure | Comparative steel |
| 4-4 | 0.0028 | 0.300 | 0.57 | 0.120 | 0.006 | 0.04 | 0.5 | 0.0016 | 0.0004 | 0.25 | 850 | ferritic single phase | Comparative steel |
| 5-1 | 0.0031 | 0.250 | 1.85 | 0.110 | 0.007 | 0.04 | 1.0 | 0.0022 | 0.0006 | 0.27 | 840 | mixed structure | Steel of invention |
| 5-2 | 0.0034 | 0.013 | 2.30 | 0.080 | 0.007 | 0.04 | 2.5 | 0.0019 | 0.0003 | 0.16 | 810 | mixed structure | Steel of invention |
| 5-3 | 0.0037 | 0.370 | 0.40 | 0.160 | 0.009 | 0.04 | 0.8 | 0.0025 | 0.0003 | 0.12 | 840 | ferritic single phase | Comparative steel |

TABLE 2

| Steel No. | YP kgf/mm² | TS kgf/mm² | El % | r | WH kgf/mm² | BH kgf/mm² | YP-El* % | σd** kgf/mm² | Brittle transition temp. °C. | Note |
|---|---|---|---|---|---|---|---|---|---|---|
| 1-1 | 13 | 30 | 52 | 1.8 | 4.9 | 5.2 | 0.0 | 22.7 | −80 | SI |
| 1-2 | 15 | 31 | 50 | 2.0 | 5.3 | 6.8 | 0.0 | 27.1 | −80 | SI |
| 1-3 | 20 | 30 | 45 | 1.2 | 3.9 | 3.2 | 0.3 | 27.1 | −70 | CS |
| 2-1 | 16 | 35 | 47 | 1.9 | 5.1 | 5.0 | 0.0 | 24.2 | −70 | SI |
| 2-2 | 17 | 37 | 46 | 1.8 | 5.4 | 10.1 | 0.1 | 32.5 | −80 | SI |
| 2-3 | 25 | 35 | 41 | 1.3 | 4.1 | 4.9 | 0.6 | 34.0 | −70 | CS |
| 2-4 | 27 | 36 | 38 | 1.2 | 4.4 | 4.0 | 0.4 | 35.4 | −70 | CS |
| 2-5 | 19 | 35 | 43 | 1.4 | 2.7 | 3.1 | 0.2 | 24.8 | −30 | CS |
| 3-1 | 22 | 40 | 42 | 1.8 | 6.5 | 5.0 | 0.0 | 32.2 | −70 | SI |
| 3-2 | 23 | 42 | 42 | 1.7 | 6.0 | 8.5 | 0.0 | 37.5 | −80 | SI |
| 3-3 | 30 | 40 | 35 | 1.2 | 4.3 | 4.6 | 1.1 | 38.9 | −20 | CS |
| 3-4 | 29 | 41 | 34 | 1.3 | 4.6 | 5.2 | 1.3 | 38.8 | −70 | CS |
| 3-5 | 27 | 40 | 38 | 1.3 | 3.1 | 3.4 | 0.4 | 33.5 | −20 | CS |
| 4-1 | 25 | 45 | 39 | 1.6 | 6.3 | 11.2 | 0.1 | 42.5 | −75 | SI |
| 4-2 | 24 | 46 | 38 | 1.8 | 6.6 | 6.9 | 0.0 | 37.5 | −70 | SI |
| 4-3 | 32 | 45 | 30 | 1.1 | 4.4 | 4.8 | 0.7 | 41.2 | −60 | CS |
| 4-4 | 30 | 46 | 34 | 1.4 | 2.2 | 4.2 | 0.5 | 36.4 | 5 | CS |
| 5-1 | 28 | 50 | 37 | 1.7 | 7.0 | 5.9 | 0.0 | 40.9 | −70 | SI |
| 5-2 | 26 | 50 | 38 | 1.8 | 6.4 | 6.2 | 0.0 | 38.6 | −70 | SI |
| 5-3 | 39 | 50 | 29 | 1.2 | 4.6 | 5.7 | 0.7 | 48.3 | −10 | CS |

Note:
SI = Steel of invention
CS = Comparative steel
*YP-El obtained after artificial aging the steel at 100° C. for 1 hr
**σd = YP + BH + WH

EXAMPLE 2

The influence of the soaking temperature in continuous annealing was investigated using Steel Nos 3-2 and 3-4 in Table 1. The conditions for hot rolling and cold rolling were the same as in Example 1.The cold rolled steel sheets were then heated to a soaking temperature from 860° to 930° C.

at a rate of 10° C./sec, held at the soaking temperature for 50 sec, cooled to 650° C. at an average rate of 5° C./sec, and then cooled to room temperature from 650° C. at an average rate of 80° C./sec to effect continuous annealing. The annealed sheets were further temper rolled at a draft of 1.0%. Tensile test pieces of JIS No. 5 were taken from the sheets, and tensile tested. The tensile test results are summarized in Table 3.

TABLE 3

| Steel No. | Soaking temp. °C. | YP kgf/mm² | TS kgf/mm² | El % | r | WH kgf/mm² | BH kgf/mm² | YP-El* % | σd** kgf/mm² | Brittle transition temp. °C. | Note |
|---|---|---|---|---|---|---|---|---|---|---|---|
| 3-2 | 860 | 22 | 42 | 42 | 1.7 | 6.2 | 8.1 | 0.0 | 36.3 | —80 | Steel of invention |
| | 880 | 23 | 42 | 43 | 1.8 | 6.3 | 8.8 | 0.0 | 38.1 | −80 | Steel of invention |
| | 900 | 22 | 42 | 42 | 1.7 | 6.5 | 8.7 | 0.0 | 37.2 | −80 | Steel of invention |
| 3-4 | 880 | 26 | 38 | 37 | 1.5 | 4.4 | 3.1 | 0.3 | 33.5 | —50 | Comparative steel |
| | 910 | 30 | 41 | 33 | 1.2 | 4.2 | 5.0 | 1.2 | 39.2 | −70 | Comparative steel |
| | 930 | 33 | 45 | 30 | 1.2 | 4.0 | 5.1 | 1.1 | 42.1 | −75 | Comparative steel |

Note:
*YP-El obtained after artificially aging the steel at 100° C. for 1 hr
**σd = YP + BH + WH It is evident from Table 3 that there can be stably obtained a steel of the invention (Steel No. 3-2) having excellent material properties even when the soaking temperature is changed. In contrast to the steel, Comparative Steel No. 3-4 exhibits a markedly changed strength when the soaking temperature is only slightly changed. Moreover, the amount of BH and the r-value also vary greatly.

EXAMPLE 3

Steel Nos 3-1 to 3-5 and Steel Nos 4-1 to 4-4 in Table 1 were hot rolled under the following conditions to give steel sheets having a thickness of 3.8 mm: a slab heating temperature of 1200° C., a finish temperature of 930° C. and a coiling temperature of 720° C. The steel sheets were pickled, and cold rolled to give cold rolled steel sheets having a thickness of 0.75 mm. The steel sheets were then heated to the same annealing temperature as in Example 1 at a rate of 15° C./sec, cooled at a rate of about 70° C./sec, conventionally hot dip coated with zinc at 460° C. (Al concentration in the bath: 0.11%), further heated at 520° C. for 20 sec to effect alloying treatment, and cooled to room temperature at a rate of about 20° C./sec. Measurements of the appearance of the coating, the powdering properties and the Fe concentration in the coating were made of the alloyed zinc-coated steel sheets thus obtained. The results thus obtained are summarized in Table 4.

TABLE 4

| Steel No. | Coating appearance | Powdering | Fe concentration % | Note |
|---|---|---|---|---|
| 3-1 | ⊕ | 5 | 10.1 | Steel of invention |
| 3-2 | ⊕ | 5 | 9.9 | Steel of invention |
| 3-3 | Δ | 3 | 2.5 | Comparative steel |
| 3-4 | x | 2 | 3.6 | Comparative steel |
| 3-5 | xx | 2 | 2.7 | Comparative steel |
| 4-1 | ⊕ | 5 | 9.5 | Steel of invention |
| 4-2 | ⊕ | 5 | 10.3 | Steel of invention |
| 4-3 | xx | —* | —* | Comparative steel |
| 4-4 | Δ | 2 | 2.5 | Comparative steel |

Note:
*Measurement becoming impossible

The appearance of the coating was evaluated under the following criteria:

⊕: the coating adhering to the sheet in an area ratio of 100%, o: the coating adhering to the sheet in an area ratio of at least 90%, Δ: the coating adhering to the sheet in an area ratio from 60 to 90%, x: the coating adhering to the sheet in an area ratio from 30 to 60%, and xx: the coating adhering to the sheet in an area ratio of only up to 30%.

The coating adhesion (powdering) herein was measured by adhesion bending the sheet at an angle of 180°, allowing an adhesive tape to adhere to the bent portion, peeling the tape, and judging the peeled state of the zinc coating from the amount of the peeled coating adhering to the tape. The peeled state was evaluated by the following five ranks: 1: a large amount of peeling, 2: a medium amount of peeling, 3: a small amount of peeling, 4: a trace amount of peeling, and 5: no peeling.

Furthermore, the Fe concentration in the coating layer was obtained by X-ray diffraction.

It is evident from Table 4 that the steels of the present invention exhibit a good coating appearance and good powdering properties, and have Fe concentrations in the alloy layer corresponding to that of the δ1 phase which is considered to be a desirable phase. The results as described above are obtained probably because P, B and Si which deteriorate the coating adhesion and retard the alloying reaction rate are decreased and Mn and Cr are added in the present invention. Moreover, when Mn and Cr are added, P and Si contained in the steels to some extent are found not to impair the coating characteristics of the steels.

EXAMPLE 4

Steel slabs having compositions as shown in Table 5 were hot rolled under the following conditions to give steel strips having a thickness of 4.0 mm: a slab heating temperature of 1180° C., a finish temperature of 910° C. and a coiling temperature of 600° C. The strips were pickled, and cold rolled at a draft of 80% to give cold rolled steel sheets having a thickness of 0.8 mm. The steel sheets were then continuously annealed under the following conditions: a heating rate of 10° C./sec, a soaking temperature from 810° to 920° C. and a soaking time of 50 sec and an average cooling rate of 60° C./sec. The resultant sheets were further temper rolled at a reduction of 0.5%. Tensile test pieces of JIS No. 5 were taken from the sheets, and tensile tested. The tensile test results are summarized in Table 6.

The amount of WH herein designates an amount of work hardening produced when a tensile strain in an amount of 2% is imparted to the test pieces in the rolling direction, and is obtained by subtracting a yield stress (YP) from a 2% deformation stress. Moreover, the amount of BH is an amount of stress increase produced when the test pieces to which prestrain in an amount of 2% has been imparted are heat treated at 170° C. for 20 minutes (heat treatment corresponding to paint baking) and tensile tested again (value obtained by subtracting the 2% deformation stress from the lower yield stress at the time of tensile testing again). Moreover, the secondary work brittle transition temperature is a ductility-brittle transition temperature obtained by punching the temper rolled steel sheets to give blanks having a diameter of 50 mm, forming cups with a punch having a diameter of 33 mm, and subjecting the cups to a drop weight tear test at various temperatures.

TABLE 5

| Steel No. | C | Si | Mn | P | S | Al | Cr | Ti | Nb | N | B | Soaking temp. °C. | Second phase volume ratio % | Note |
|---|---|---|---|---|---|---|---|---|---|---|---|---|---|---|
| | Chemical components of steels (wt. %) | | | | | | | | | | | | | |
| 1-1 | 0.003 | 0.007 | 0.88 | 0.007 | 0.004 | 0.04 | — | — | 0.025 | 0.0018 | — | 890 | 15 | Steel of invention |
| 1-2 | 0.004 | 0.011 | 0.81 | 0.010 | 0.006 | 0.03 | 0.4 | 0.010 | 0.012 | 0.0019 | 0.0002 | 880 | 17 | Steel of invention |
| 1-3 | 0.003 | 0.010 | 0.15 | 0.030 | 0.007 | 0.03 | — | — | 0.013 | 0.0027 | 0.0017 | 910 | 3 | Comparative steel |
| 2-1 | 0.002 | 0.015 | 1.15 | 0.030 | 0.006 | 0.03 | — | 0.021 | — | 0.0022 | 0.0003 | 880 | 22 | Steel of invention |
| 2-2 | 0.004 | 0.008 | 1.20 | 0.008 | 0.005 | 0.04 | 0.7 | — | 0.018 | 0.0015 | — | 880 | 36 | Steel of invention |
| 2-3 | 0.004 | 0.015 | 0.62 | 0.018 | 0.010 | 0.07 | — | — | 0.027 | 0.0021 | 0.0033 | 910 | 22 | Comparative steel |
| 2-4 | 0.003 | 0.010 | 0.20 | 0.011 | 0.007 | 0.04 | — | 0.035 | 0.019 | 0.0025 | 0.0059 | 920 | 25 | Comparative steel |
| 2-5 | 0.002 | 0.520 | 0.15 | 0.014 | 0.004 | 0.03 | — | 0.040 | — | 0.0016 | 0.0002 | 880 | 0 | Comparative steel |
| 3-1 | 0.002 | 0.011 | 1.40 | 0.065 | 0.006 | 0.03 | 1.0 | 0.021 | 0.011 | 0.0022 | 0.0002 | 860 | 19 | Steel of invention |
| 3-2 | 0.004 | 0.008 | 1.65 | 0.070 | 0.005 | 0.04 | — | — | 0.020 | 0.0015 | 0.0004 | 860 | 25 | Steel of invention |
| 3-3 | 0.004 | 0.022 | 0.15 | 0.105 | 0.009 | 0.04 | 0.8 | — | 0.006 | 0.0025 | 0.0030 | 900 | 34 | Comparative steel |
| 3-4 | 0.004 | 0.028 | 0.76 | 0.012 | 0.006 | 0.04 | — | 0.025 | 0.025 | 0.0033 | 0.0015 | 900 | 18 | Comparative steel |
| 3-5 | 0.003 | 0.150 | 0.550 | 0.090 | 0.005 | 0.030 | 0.2 | 0.010 | 0.015 | 0.002 | — | 870 | 0 | Comparative steel |
| 4-1 | 0.005 | 0.009 | 2.20 | 0.080 | 0.006 | 0.05 | — | 0.007 | 0.025 | 0.0014 | 0.0003 | 840 | 46 | Steel of invention |
| 4-2 | 0.003 | 0.012 | 1.75 | 0.075 | 0.008 | 0.04 | 1.6 | 0.020 | 0.019 | 0.0018 | — | 820 | 21 | Steel of invention |
| 4-3 | 0.008 | 0.850 | 0.41 | 0.060 | 0.007 | 0.05 | 0.1 | — | 0.015 | 0.0022 | 0.0045 | 900 | 24 | Comparative steel |
| 4-4 | 0.003 | 0.200 | 0.60 | 0.120 | 0.006 | 0.04 | 0.5 | 0.020 | 0.010 | 0.0017 | 0.0002 | 850 | 0 | Comparative steel |
| 5-1 | 0.003 | 0.015 | 1.85 | 0.110 | 0.005 | 0.03 | 1.0 | 0.026 | 0.014 | 0.0022 | 0.0001 | 840 | 31 | Steel of invention |
| 5-2 | 0.003 | 0.013 | 2.30 | 0.070 | 0.007 | 0.03 | 2.4 | 0.010 | 0.045 | 0.0019 | 0.0003 | 810 | 17 | Steel of invention |
| 5-3 | 0.004 | 0.310 | 0.70 | 0.140 | 0.009 | 0.04 | 1.0 | 0.025 | 0.006 | 0.0024 | 0.0003 | 840 | 0 | Comparative steel |

TABLE 6

| Steel No. | YP kgf/mm² | TS kgf/mm² | El % | r | WH kgf/mm² | BH kgf/mm² | YP-El* % | σd** kgf/mm² | Br. tans. temp. °C. | Sec. phase vol. ratio % | Note |
|---|---|---|---|---|---|---|---|---|---|---|---|
| 1-1 | 13 | 31 | 51 | 2.3 | 6.1 | 5.1 | 0.0 | 24.2 | −80 | 15 | SI |
| 1-2 | 14 | 32 | 49 | 2.2 | 5.8 | 7.4 | 0.0 | 27.2 | −80 | 17 | SI |
| 1-3 | 15 | 30 | 46 | 1.7 | 4.6 | 4.4 | 0.4 | 27.0 | −70 | 3 | CS |
| 2-1 | 15 | 36 | 46 | 2.2 | 6.1 | 5.0 | 0.0 | 25.3 | −75 | 22 | SI |
| 2-2 | 16 | 35 | 46 | 2.4 | 6.7 | 8.6 | 0.0 | 31.3 | −80 | 36 | SI |
| 2-3 | 22 | 36 | 42 | 1.5 | 4.9 | 5.5 | 0.7 | 32.4 | −80 | 22 | CS |
| 2-4 | 22 | 37 | 38 | 1.8 | 4.2 | 6.3 | 1.0 | 32.5 | −80 | 25 | CS |
| 2-5 | 21 | 35 | 42 | 1.7 | 1.5 | 0.2 | 0.0 | 22.7 | −30 | 0 | CS |
| 3-1 | 19 | 40 | 43 | 2.1 | 6.5 | 5.1 | 0.0 | 29.8 | −75 | 19 | SI |
| 3-2 | 21 | 41 | 42 | 2.0 | 6.6 | 10.2 | 0.0 | 37.8 | −80 | 25 | SI |
| 3-3 | 28 | 41 | 37 | 1.6 | 5.1 | 6.0 | 1.4 | 39.1 | −75 | 34 | CS |
| 3-4 | 25 | 41 | 36 | 1.8 | 5.3 | 5.9 | 1.2 | 36.2 | −70 | 18 | CS |
| 3-5 | 29 | 40 | 35 | 1.4 | 1.9 | 1.1 | 0.0 | 32.0 | −15 | 0 | CS |
| 4-1 | 24 | 45 | 40 | 2.1 | 5.4 | 11.0 | 0.1 | 40.4 | −75 | 46 | SI |
| 4-2 | 23 | 44 | 36 | 1.9 | 6.6 | 5.0 | 0.0 | 33.9 | −70 | 21 | SI |
| 4-3 | 29 | 45 | 34 | 1.2 | 4.4 | 4.8 | 0.8 | 38.2 | −60 | 24 | CS |
| 4-4 | 30 | 46 | 34 | 1.4 | 2.2 | 0.8 | 0.0 | 33.0 | −0 | 0 | CS |
| 5-1 | 26 | 50 | 38 | 1.9 | 7.0 | 7.2 | 0.0 | 40.2 | −70 | 31 | SI |
| 5-2 | 25 | 50′ | 37 | 2.0 | 6.6 | 5.3 | 0.0 | 36.1 | −65 | 17 | SI |
| 5-3 | 37 | 49 | 31 | 1.3 | 2.8 | 1.9 | 0.1 | 41.7 | −20 | 0 | CS |

Note:
SI = Steel of invention
CS = Comparative steel
*YP-El obtained after artificial aging the steel at 100° C. for 1 hr
**σd = YP + BH + WH
Br. trans. temp. = Brittle transition temperature
Sec. phase vol. ratio = Second phase volume ratio It is evident from Table 6 that the steels of the present invention have high paint bake hardenability which has never been obtained in steel sheets of conventional steels having a tensile strength of the same level, and in addition very excellent non-aging properties. The principal reason for the preferable results of the steels in the present invention is probably as follows: those steel sheets which are made to have a mixed structure by adding Mn and Cr have a preferable dislocation density compared with steel sheets which are made to have a composite structure by adding B and Nb. Moreover, the steels of the present invention have a low yield strength, excellent surface shaping properties, a large amount of WH and a high r-value. Accordingly, the steels are appropriate materials, for example, for outside and inside panels of automobiles.

EXAMPLE 5

The influence of the soaking temperature in continuous annealing was investigated using Steel Nos 3-2 and 3-4 in Table 5. Conditions for hot rolling and cold rolling were the same as in Example 4. The resultant cold rolled sheets were continuously annealed by heating at 10° C./sec, holding at a soaking temperature from 860° to 920° C. for 50 sec, and cooling at an average rate of 60° C./sec. The annealed sheets were further temper rolled at a reduction of 0.5%. Tensile test pieces of JIS No. 5 were taken from the sheets, and tensile tested. The results of the tensile test are summarized in Table 7.

TABLE 7

| Steel No. | Soaking temp. °C. | YP kgf/mm² | TS kgf/mm² | El % | r | WH kgf/mm² | BH kgf/mm² | YP-El* % | σd** kgf/mm² | Brittle transition temp. °C. | Second phase volume ratio % | Note |
|---|---|---|---|---|---|---|---|---|---|---|---|---|
| 3-2 | 860 | 21 | 41 | 42 | 2.0 | 6.6 | 10.2 | 0.0 | 37.8 | −80 | 25 | Steel of invention |
| | 880 | 20 | 41 | 43 | 2.1 | 6.8 | 9.9 | 0.0 | 36.7 | −75 | 35 | Steel of invention |
| | 900 | 22 | 42 | 41 | 2.0 | 7.1 | 10.3 | 0.0 | 39.4 | −80 | 51 | Steel of invention |
| 3-4 | 880 | 18 | 32 | 40 | 1.5 | 2.3 | 1.1 | 0.0 | 21.4 | −15 | 0 | Comparative steel |
| | 900 | 25 | 41 | 36 | 1.8 | 5.3 | 5.9 | 1.2 | 36.2 | −70 | 18 | Comparative steel |
| | 920 | 33 | 45 | 33 | 1.2 | 5.1 | 4.9 | 1.1 | 43.0 | −75 | 80 | Comparative steel |

Note:
*YP-El obtained after artificially aging the steel at 100° C. for 1 hr
**σd = YP + BH + WH It is evident from Table 7 that there can be stably obtained in the present invention steels having excellent material properties even when the soaking temperature is changed. In contrast to the steels of the invention, Comparative Steel No. 3-4 exhibits a markedly changed strength when the soaking temperature is only slightly changed. Moreover, the amount of BH and the r-value also vary greatly.

EXAMPLE 6

The influence of the cooling condition after soaking and holding in continuous annealing was investigated using Steel Nos 3-2 and 3-4 in Table 5. Conditions for hot rolling and cold rolling were the same as in Example 4. After cold rolling, the steel sheets were heated at 10° C./sec, held for 50 sec at 880° C. or 900° C., cooled to 750° C. at an average rate from 3 to 60° C./sec, and cooled to room temperature at an average rate from 750° to 60° C./sec. The sheets were further temper rolled at a reduction of 0.5%. Tensile test pieces of JIS No. 5 were taken from the sheets, and tensile tested. The results of tensile test are summarized in Table 8.

TABLE 8

| Steel No. | Soaking temp. °C. | Cold rolling rate °C./sec | YP kgf/mm² | TS kgf/mm² | El % | r | WH kgf/mm² | BH kgf/mm² | YP-El* % | σd** kgf/mm² | Brittle transition temp. °C. | Second phase volume ratio % | Note |
|---|---|---|---|---|---|---|---|---|---|---|---|---|---|
| 3-2 | 880 | 60 | 20 | 41 | 43 | 2.1 | 6.8 | 9.9 | 0.0 | 36.7 | −75 | 35 | Steel of invention |
| | | 3 | 19 | 41 | 44 | 2.2 | 6.7 | 9.6 | 0.0 | 35.3 | −75 | 31 | Steel of invention |
| | | 20 | 21 | 41 | 43 | 2.1 | 6.5 | 10.1 | 0.0 | 37.6 | −70 | 33 | Steel of invention |
| 3-4 | 900 | 60 | 25 | 41 | 36 | 1.8 | 5.3 | 5.9 | 1.2 | 36.2 | −70 | 18 | Comparative steel |
| | | 3 | 20 | 34 | 38 | 1.4 | 2.5 | 0.8 | 0.0 | 23.3 | −30 | 3 | Comparative steel |
| | | 20 | 23 | 38 | 37 | 1.6 | 3.5 | 3.4 | 0.2 | 29.9 | −65 | 10 | Comparative steel |

Note:
*YP-El obtained after artificially aging the steel at 100° C. for 1 hr
**σd = YP + BH + WH It is evident from Table 8 that Steel No. 3-2 of the invention can extremely stably exhibit excellent material properties even when the cooling rate after soaking is changed. In contrast to the steel of the invention, Comparative Steel No. 3-4 exhibits a markedly changed strength when the cooling rate is only slightly changed. Moreover, the amount of BH and the r-value also vary greatly.

EXAMPLE 4

Steel Nos 3-1 to 3-5 and Steel Nos 4-1 to 4-4 in Table 5 were hot rolled under the following conditions to give steel sheets having a thickness of 3.8 mm: a slab heating temperature of 1220° C., a finish temperature of 900° C. and a coiling temperature of 500° C. The steel sheets were pickled, and cold rolled to give cold rolled steel sheets having a thickness of 7.5 mm. The steel sheets were then heated to the maximum heating temperature of 890° C. at a rate of 15° C./sec, cooled at a rate of about 70° C./sec, conventionally hot dip coated with zinc at 460° C. (Al concentration in the bath: 0.11%), further heated at 520° C. for 20 sec to effect alloying treatment, and cooled to room temperature at a rate of about 20° C./sec. Measurements of the appearance of the coating, the powdering properties and the Fe concentration in the coating were made on the alloyed zinc-coated steel sheets thus obtained. The results thus obtained are summarized in Table 9.

The appearance of the coating was evaluated under the following criteria:

⊕: the coating adhering to the sheet in an area ratio of 100%,

○: the coating adhering to the sheet in an area ratio of at least 90%,

Δ: the coating adhering to the sheet in an area ratio from 60 to 90%, x: the coating adhering to the sheet in an area ratio from 30 to 60%, and xx: the coating adhering to the sheet in an area ratio of only up to 30%.

The powdering properties herein were measured by adhesion bending the sheet at an angle of 180° , allowing an adhesive tape to adhere to the bent portion, peeling the tape, and judging the peeled state of the zinc coating from the amount of the peeled coating adhering to the tape. The amount was evaluated by the following five ranks: 1: a large amount of peeling, 2: a medium amount of peeling, 3: a small amount of peeling, 4: a trace amount of peeling, and 4: no peeling.

Furthermore, the Fe concentration in the coating layer was obtained by X-ray diffraction.

TABLE 9

| Steel No. | Coating appearance | Powdering | Fe concn. % | Second phase vol. ratio % | Note |
|---|---|---|---|---|---|
| 3-1 | ⊕ | 5 | 10.5 | 46 | Steel of invention |
| 3-2 | ⊕ | 5 | 9.8 | 50 | Steel of invention |
| 3-3 | x | 2 | 1.1 | 16 | Comparative steel |
| 3-4 | Δ | 3 | 3.3 | 6 | Comparative steel |
| 3-5 | x | 2 | 2.5 | 0 | Comparative steel |
| 4-1 | ⊕ | 5 | 9.7 | 64 | Steel of invention |
| 4-2 | ⊕ | 5 | 10.0 | 72 | Steel of invention |
| 4-3 | xx | 2 | —* | 5 | Comparative steel |
| 4-4 | Δ | 2 | 2.0 | 0 | Comparative steel |

Note:
Fe concn. = Fe concentration
*Measurement becoming impossible

It is evident from Table 9 that the steels of the present invention exhibit a good coating appearance and good powdering properties compared with conventional steels, and have Fe concentrations in the alloy layer corresponding to that of the δ1 phase which is considered to be a desirable phase. The results as described above are obtained probably because P, B and Si which deteriorate the coating adhesion and retard the alloying reaction rate are decreased and Fin and Cr are added in the present invention. Moreover, when Mn and Cr are added, P and Si contained in the steels to some extent are found not to impair the coating characteristics of the steels.

POSSIBILITY OF UTILIZATION IN THE INDUSTRY

It is evident from the explanation as described above that the present invention may provide a cold rolled steel sheet having a paint bake hardenability which heretofore has never been realized and non-aging properties. Moreover, the steel of the present invention has extremely good press formability, and can exhibit a rust-preventive function because the steel is excellent in hot dip zinc coating characteristics. As a result, when the steel of the invention is used as a body or frame of an automobile, the sheet thickness can be reduced, that is, lightening the body becomes possible. The present invention therefore can greatly contribute to the maintenance of the global environment to which much attention has recently been paid. As described above, the industrial significance of the present invention is extremely great.

We claim:

1. A cold rolled steel sheet excellent in paint bake hardenability, non-aging properties and formability, which consists essentially of, in terms of percentage by weight, from 0.0005 to 0.0070% of C, from 0.001 to 0.8% of Si, from 0.3 to 4.0% of Mn, from 0.003 to 0.15% of P, from 0.0005 to 0.015% of S, from 0.005 to 0.20% of Al, from 0.0003 to 0.0060% of N, less than 0.0030% by weight of B, said B satisfying the conditions B/N<1.5, and the balance Fe and unavoidable impurities, and which has a mixed structure comprising phases transformed at low temperature in an amount greater than 5% based on total volume and ferrite.

2. The cold rolled steel sheet according to claim 1, wherein the steel sheet further contains from 0.01 to 3.0% by weight of Cr and less than 0.0030% by weight of B, said B satisfying the condition B/N≦1.5.

3. A cold rolled steel sheet excellent in paint bake hardenability, non-aging properties and formability, which is composed of, in terms of percentage by weight, from 0.0005 to 0.0070% of C, from 0.001 to 0.8% of Si, from 0.8 to 4.0% of Mn, from 0.005 to 0.15% of P, from 0.0010 to 0.015% of S, from 0.005 to 0.1% of Al, from 0.0003 to 0.0060% of N, less than 0.0005% of B, said B satisfying the condition B/N <1.5, one or two elements selected from the group consisting of Ti in an amount from 0.003 to 0.1% and Nb in an amount from 0.003 to 0.1%, and the balance Fe and unavoidable impurities, and which has a mixed structure comprising phases transformed at low temperature in an amount greater than 5% based on the total volume and ferrite.

4. The cold rolled steel sheet according to claim 3, wherein the steel sheet further contains from 0.01 to 3.0% by weight of Cr.

5. A hot dip zinc-coated cold rolled steel sheet excellent in paint bake hardenability, non-aging properties and formability, which consists essentially of, in terms of percentage by weight, from 0.0005 to 0.0070% of C, from 0.001 to 0.8% of Si, from 0.3 to 4.0% of Mn, from 0.003 to 0.15% of P, from 0.0005 to 0.015% of S, from 0.005 to 0.20% of Al, from 0.0003 to 0.0060% of N less than 0.0030% by weight of B, said B satisfying the condition B/N<1.5 and the balance Fe and unavoidable impurities, and which has a mixed structure comprising a product transformed at low temperature in an amount greater than 5% based on total volume and ferrite.

6. The hot dip zinc-coated cold rolled steel sheet according to claim 5, wherein the steel sheet further contains from 0.01 to 3.0% by weight of Cr and less than 0.0030% by weight of B, said B satisfying the condition B/N<1.5.

7. A hot dip zinc-coated cold rolled steel sheet excellent in paint bake hardenability, non-aging properties and formability, which is composed of, in terms of percentage by weight, from 0.0005 to 0.0070% of C, from 0.001 to 0.8% of Si, from 0.8 to 4.0% of Mn, from 0.005 to 0.15% of P, from 0.0010 to 0.015% of S, from 0.005 to 0.1% of Al, from 0.0003 to 0.0060% of N, less than 0.0005% of B, said B satisfying the condition B/N<1.5, one or two elements selected from the group consisting of Ti in an amount from 0.003 to 0.1% and Nb in an amount from 0.003 to 0.1%, and the balance Fe and unavoidable impurities, and which has a mixed structure comprising phases transformed at low temperature in an amount greater than 5% based on the total volume and ferrite.

8. The hot dip zinc-coated cold rolled steel sheet according to claim 7, wherein the steel sheet further contains from 0.01 to 3.0% by weight of Cr.

9. A process for producing a cold rolled steel sheet excellent in paint bake hardenability, non-aging properties and formability, which comprises heating a slab consisting essentially of, in terms of percentage by weight, from 0.0005 to 0.0070% of C, from 0.001 to 0.8% of Si, from 0.3 to 4.0% of Mn, from 0.003 to 0.15% of P, from 0.0005 to 0.015% of S, from 0.005 to 0.20% of Al, from 0.0003 to 0.0060% of N less than 0.0030% by weight of B, said B satisfying the condition B/N<1.5 and the balance Fe and unavoidable impurities, hot rolling the slab and finishing hot rolling at a temperature of at least (Ar3-100)°C. to give a hot rolled steel strip, coiling the hot rolled steel strip in a temperature range from 800° C. to room temperature, cold rolling the hot rolled steel strip after coiling at a reduction of at least 60% to give a cold rolled steel strip, and annealing the cold rolled steel strip by inserting the steel strip in an annealing furnace whose soaking temperature is adjusted in a temperature range from at least the $\alpha \rightarrow \gamma$ transformation temperature to up to the Ac3 transformation temperature and forming a mixed structure comprising phases transformed at a low temperature in an amount greater than 5% based on total volume and ferrite.

10. The process for producing a cold rolled steel sheet according to claim 9, wherein the slab further contains from 0.01 to 3.0% by weight of Cr and less than 0.0030% by weight of B, said B satisfying the condition B/N≦1.5.

11. A process for producing a cold rolled steel sheet excellent in paint bake hardenability, non-aging properties and formability, which comprises heating a slab consisting essentially of, in terms of percentage by weight, from 0.0005 to 0.0070% of C, from 0.001 to 0.8% of Si, from 0.8 to 4.0% of Mn, from 0.005 to 0.15% of P, from 0.0010 to 0.015% of S, from 0.005 to 0.1% of Al, from 0.0003 to 0.0060% of N, less than 0.0005% of B, said B satisfying the condition B/N<1.5,one or two elements selected from the group consisting of Ti in an amount from 0.003 to 0.1% and Nb in an amount from 0.003 to 0.1%, and the balance Fe and unavoidable impurities, hot rolling the slab and finishing hot rolling at a temperature of at least (Ar3-100)°C. to give a hot rolled steel strip, coiling the hot rolled steel strip in a temperature range from 800° C. to room temperature, cold rolling the hot rolled steel strip after coiling at a reduction of at least 60% to give a cold rolled steel strip, and annealing the cold rolled steel strip by inserting the steel strip in an annealing furnace whose soaking temperature is adjusted in a temperature range from at least the $\alpha \rightarrow \gamma$ transformation temperature to up to the Ac3 transformation temperature and forming a mixed structure comprising phases transformed at a low temperature in an amount greater than 5% based on total volume and ferrite.

12. The process for producing a cold rolled steel sheet according to claim 11, wherein the slab further contains from 0.01 to 3.0% by weight of Cr.

13. A process for producing a hot dip zinc-coated cold rolled steel sheet excellent in bake hardenability, non-aging properties and formability, which comprises heating a slab consisting essentially of, in terms of percentage by weight, from 0.0005 to 0.0070% of C, from 0.001 to 0.8% of Si, from 0.3 to 4.0% of Mn, from 0.003 to 0.15% of P, from 0.0005 to 0.015% of S, from 0.005 to 0.20% of Al, from 0.0003 to 0.0060% of N, less than 0.0030% by weight of B, said B satisfying the condition B/N<1.5 and the balance Fe and unavoidable impurities, hot rolling the slab and finishing hot rolling at a temperature of at least (Ar3-100)°C. to give a hot rolled steel strip, coiling the hot rolled steel strip in a temperature range from 800° C. to room temperature, cold rolling the hot rolled steel strip after coiling at a draft of at least 60% to give a cold rolled steel strip, annealing the cold rolled steel strip by inserting the steel strip in an annealing furnace whose soaking temperature is adjusted in a temperature range from at least the $\alpha \rightarrow \gamma$ transformation temperature to up to the Ac3 transformation temperature, forming a mixed structure comprising phases transformed at a low temperature in an amount greater than 5% based on total volume and ferrite, and coating the annealed strip with zinc by immersing the strip in a hot dip zinc coating bath.

14. The process for producing a hot dip zinc-coated cold rolled steel sheet according to claim 13, wherein the slab further contains from 0.01 to 3.0% by weight of Cr and less than 0.0030% by weight of B, said B satisfying the condition B/N≦1.5.

15. A process for producing a hot dip zinc-coated cold rolled steel sheet excellent in paint bake hardenability, non-aging properties and formability, which comprises heating a slab consisting essentially of, in terms of percentage by weight, from 0.0005 to 0.0070% of C, from 0.001 to 0.8% of Si, from 0.8 to 4.0% of Mn, from 0.005 to 0.15% of P, from 0.0010 to 0.015% of S, from 0.005 to 0.1% of Al, from 0.0003 to 0.0060% of N, less than 0.0005% of B, said B satisfying the condition B/N<1.5, one or two elements selected from the group consisting of Ti in an amount from 0.003 to 0.1%, and Nb in an amount from 0.003 to 0.1%, and the balance Fe and unavoidable impurities, hot rolling the slab and finishing hot rolling at a temperature of at least (Ar3-100)°C. to give a hot rolled steel strip, coiling the hot rolled steel strip in a temperature range from 800° C. to room temperature, cold rolling the hot rolled steel strip after coiling at a reduction of at least 60% to give a cold rolled steel strip, annealing the cold rolled steel strip by inserting the steel strip in an annealing furnace whose soaking temperature is adjusted in a temperature range from at least the $\alpha \rightarrow \gamma$ transformation temperature to up to the Ac3 transformation temperature, forming a mixed structure comprising phases transformed at a low temperature in an amount greater than 5% based on total volume and ferrite, and coating the annealed strip with zinc by immersing the strip in a hot dip zinc coating bath.

16. The process for producing a hot dip zinc-coated cold rolled steel sheet according to claim 15, wherein the steel slab further contains from 0.01 to 3.0% by weight of Cr.

* * * * *

UNITED STATES PATENT AND TRADEMARK OFFICE

CERTIFICATE OF CORRECTION

PATENT NO. : 5,470,403

DATED : November 28, 1995

INVENTOR(S) : Naoki YOSHINAGA, et al.

It is certified that error appears in the above-indentified patent and that said Letters Patent is hereby corrected as shown below:

Column 2, line 31, change "Fin" to --Mn--.

Column 2, line 63, change "concluded" to --summarized--.

Column 2, line 64, after "role" insert --to that--.

Column 3, line 12, change "A3" to --$\mathbf{A_3}$--.

Column 5, line 50, change "have" to --having--.

Column 6, line 50, delete "not".

Column 7, line 24, change "Ar3" to --$Ar_3$--.

Column 7, line 28, change "Ac3" to --$Ac_3$--.

Column 7, line 32, change "Ac3" to --$Ac_3$--.

Column 7, line 53, change "Ar3" to --$Ar_3$--.

Column 7, line 58, change "Ac3" to --$Ac_3$--.

Column 7, line 62, change "Ac3" to --$Ac_3$--.

Column 9, line 64, change "form ability" to --formability--.

UNITED STATES PATENT AND TRADEMARK OFFICE

CERTIFICATE OF CORRECTION

PATENT NO. : 5,470,403

DATED : November 28, 1995

INVENTOR(S) : Naoki YOSHINAGA, et al.

It is certified that error appears in the above-indentified patent and that said Letters Patent is hereby corrected as shown below:

Column 10, line 37, change "Ar3" to --$Ar_3$--.

Column 11, line 51, change "Ac3" to --$Ac_3$--.

Column 13, line 62, change "properties." to --property.--.

Column 16, line 45, change " 1" to -- i--.

Column 17, Table 6, second column, third line down, change "15" to --18--.

Column 18, Table 6, change heading in 10th column from "Br tans" to --Br trans--.

Column 21, line 65, change " 1" to -- i--.

Column 22, line 1, change "Fin" to --Mn--.

Column 22, line 62, after "N" insert a comma.

Column 23, line 40, change "Ac3" to --$Ac_3$--.

Column 23, line 60, change "Ar3" to --$Ar_3$--.

UNITED STATES PATENT AND TRADEMARK OFFICE

CERTIFICATE OF CORRECTION

PATENT NO. : 5,470,403

DATED : November 28, 1995

INVENTOR(S) : Naoki YOSHINAGA, et al.

It is certified that error appears in the above-indentified patent and that said Letters Patent is hereby corrected as shown below:

Column 24, line 1, change "Ac3" to --$Ac_3$--

Column 24, line 19, change "Ar3" to --$Ar_3$--.

Column 24, line 27, change "Ac3" to --$Ac_3$--.

Column 24, line 50, change "Ar3" to --$Ar_3$--.

Column 24, line 57, change "Ac3" to --$Ac_3$--.

Signed and Sealed this

Sixth Day of August, 1996

*Attest:*

*Attesting Officer*

BRUCE LEHMAN

*Commissioner of Patents and Trademarks*